US012215551B2

(12) United States Patent
Brocato

(10) Patent No.: US 12,215,551 B2
(45) Date of Patent: Feb. 4, 2025

(54) AUGER BORING USING A PIPE SEAL ASSEMBLY TO JOIN TOGETHER CASING PIPE SECTIONS

(71) Applicant: Brocato Construction Company Inc., Batesville, MS (US)

(72) Inventor: Chris Brocato, Batesville, MS (US)

(73) Assignee: Brocato Construction Company Inc., Batesville, MS (US)

( * ) Notice: Subject to any disclaimer, the term of this patent is extended or adjusted under 35 U.S.C. 154(b) by 0 days.

(21) Appl. No.: 18/149,739

(22) Filed: Jan. 4, 2023

(65) Prior Publication Data

US 2024/0084649 A1 Mar. 14, 2024

Related U.S. Application Data

(60) Provisional application No. 63/375,486, filed on Sep. 13, 2022.

(51) Int. Cl.

| | |
|---|---|
| ***E21B 17/04*** | (2006.01) |
| ***E21B 7/04*** | (2006.01) |
| ***E21B 19/16*** | (2006.01) |

(52) U.S. Cl.

CPC ..... *E21B 17/04* (2013.01); *E21B 19/16* (2013.01); *E21B 7/046* (2013.01)

(58) Field of Classification Search

CPC ..... E21B 17/042; E21B 17/046; E21B 6/00; E21B 7/002; E21B 7/046; E21B 17/04; E21B 19/16; F16L 21/08; F16L 21/02; F16L 25/065

See application file for complete search history.

(56) References Cited

U.S. PATENT DOCUMENTS

| | | | | |
|---|---|---|---|---|
| 784,416 | A | 3/1905 | McDonald | |
| 795,976 | A | 8/1905 | Herrick | |
| 841,806 | A | 3/1906 | Sands | |
| 3,028,180 | A | 4/1962 | Smith | |
| 3,162,254 | A * | 12/1964 | Rose | E21B 7/201 173/148 |
| 3,223,439 | A | 12/1965 | Stevens | |
| 3,669,475 | A | 6/1972 | Luckenbill et al. | |
| 3,920,270 | A | 11/1975 | Babb, Jr. | |
| 4,438,954 | A | 3/1984 | Hattori | |
| 5,351,999 | A * | 10/1994 | Hattori | F16L 25/065 285/369 |
| 5,570,909 | A | 11/1996 | Reynolds, Jr. | |

(Continued)

FOREIGN PATENT DOCUMENTS

JP H07317483 A * 12/1999

*Primary Examiner* — Daniel P Stephenson

(74) *Attorney, Agent, or Firm* — Capitol City TechLaw

(57) ABSTRACT

An auger boring method may employ a pipe seal assembly to join together casing pipe sections. The pipe seal assembly may include a sleeve having two receptacles that are joined together at an internal annular flange. One receptacle may receive an end of a leading casing pipe section that includes an auger flight, and the other receptacle may receive an end of a trailing casing pipe section that includes an auger flight. The internal annular flange may serve as a stopper for axial inward displacement of the casing pipe sections. A sealing rings may be provided in each receptacle to seal against the inserted casing pipe sections. Lock screws may be provided to fix the casing pipe sections in the receptacles.

13 Claims, 3 Drawing Sheets

(56) References Cited

U.S. PATENT DOCUMENTS

| | | | | |
|---|---|---|---|---|
| 5,682,956 | A | 11/1997 | Deken et al. | |
| 5,799,984 | A | 9/1998 | Reynolds, Jr. | |
| 7,779,938 | B2 * | 8/2010 | Barbera | E21B 7/28 175/323 |
| 8,007,284 | B2 * | 8/2011 | Smith | H02G 3/0666 439/32 |
| 8,424,618 | B2 * | 4/2013 | Harrison | E21B 7/201 175/323 |
| 2009/0288883 | A1 * | 11/2009 | Barbera | E21B 7/28 175/57 |
| 2013/0049355 | A1 * | 2/2013 | Weinhold | F16L 39/005 29/525.14 |
| 2024/0084649 | A1 * | 3/2024 | Brocato | E21B 7/201 |

* cited by examiner

AUGER BORING USING A PIPE SEAL ASSEMBLY TO JOIN TOGETHER CASING PIPE SECTIONS

This application claims priority under 35 USC 119(e) to U.S. provisional patent application No. 63/375,486, which was filed on Sep. 13, 2022, the entire contents of which are incorporated herein by reference.

BACKGROUND

1. Field

Example embodiments relate in general to auger boring, and more specifically, to auger boring in which pipe joints between casing pipe sections are formed using a pipe seal assembly.

2. Discussion of Related Art

Conventional auger boring, also known as horizontal earth boring, involves boring through the soil and under a number of different obstacles, including roads, creeks, railways, or any other ground that cannot be open cut or trenched. The technique involves forming a bore hole from a drive pit to a reception pit for installation of a casing pipe, which is typically fabricated from steel. The casing pipe prevents the collapse of the bore hole walls and may receive underground pipes and utilities.

Casing pipe sections are typically jacked through the excavated hole as it is being bored. The casing pipe sections are sequentially installed and welded together as the boring continues. Each casing pipe section accommodates an auger flight. A leading auger flight is coupled to a cutting head that is used to form the bore hole. The auger flights are operatively connected together as the casing pipe sections are sequentially installed. A boring machine rotates the auger flights as it pushes and advances the trailing casing pipe section. Spoil (or excavated material) can be removed back to the drive pit by the auger flights as they rotate relative to the casing pipe sections.

When the bore hole reaches the reception pit, the auger flights are removed leaving an installed casing pipe that extends from the drive pit to the reception pit. One or more carrier pipes can be inserted into the casing pipe. The carrier pipe typically accommodates sewage or water, or some other utility installation, for example.

Although conventional techniques and structures for auger road boring and casing pipe installation are generally thought to provide acceptable performance, they are not without shortcomings. For example, welding together the casing pipe sections is time consuming and expensive. This is because the welding operation may require one or more certified welders with experience in the industry, the casing pipe sections may have large diameters (e.g., 60 inches), and numerous casing pipe section may be required depending on the drilling length. By way of example only, the casing pipe sections may be 20 feet long, and drilling lengths commonly exceed 500 feet, which would require more than 24 separate welds and associated down time for the bore forming operation.

SUMMARY

According to a non-limiting embodiment, an auger boring method may involve providing a pipe seal assembly that includes a sleeve with a leading receptacle and a trailing receptacle that are joined together at an internal annular flange. The pipe seal assembly may be pushed in a boring direction onto a leading casing pipe section that accommodates a leading auger flight, such that an end of the leading casing pipe section inserts into the leading receptacle and confronts the internal annular flange. A trailing casing pipe section that accommodates a trailing auger flight may be pushed in the boring direction, such that an end of the trailing casing pipe section inserts into the trailing receptacle and confronts the internal annular flange.

According to another non-limiting embodiment, a pipe seal assembly may be provided for use in an auger boring method. The pipe seal assembly may include a sleeve with a leading receptacle and a trailing receptacle that are joined together at an internal annular flange. Each of the leading receptacle and the trailing receptacle may include an internal annular groove, a sealing ring provided in the internal annular groove, a plurality of threaded holes that extend radially into an interior of the sleeve, and a lock screw provided in each of the threaded holes. The leading receptacle may be configured to receive an end of a leading casing pipe section that accommodates a leading auger flight. The trailing receptacle may be configured to receive an end of a trailing casing pipe section that accommodates a trailing auger flight.

The above and other features, including various and novel details of construction and combinations of parts will be more particularly described with reference to the accompanying drawings. It will be understood that the details of the example embodiments are shown by way of illustration only and not as limitations of the invention. The principles and features of this invention may be employed in varied and numerous embodiments without departing from the scope of the invention.

BRIEF DESCRIPTION OF THE DRAWINGS

Non-limiting embodiments will become more fully understood from the detailed description below and the accompanying drawings, wherein like elements are represented by like reference numerals, which are given by way of illustration only and thus are not limiting of the present invention.

DESCRIPTION OF NON-LIMITING EMBODIMENTS

This disclosure is directed to auger boring that employs a pipe seal assembly to join together casing pipe sections. The pipe seal assembly is a push-on coupling that may be installed without any welding, thereby avoiding the associated down time and expense associated with conventional techniques.

Throughout this disclosure, terms relating to spatial directions (e.g., upper, top, lower, bottom, front, forward, rear, rearward, proximal, distal, trailing, leading, etc.) are used for convenience in describing features or portions thereof, as shown in the figures. These terms do not, however, require that the disclosed structure be maintained in any particular orientation.

Figure 1:
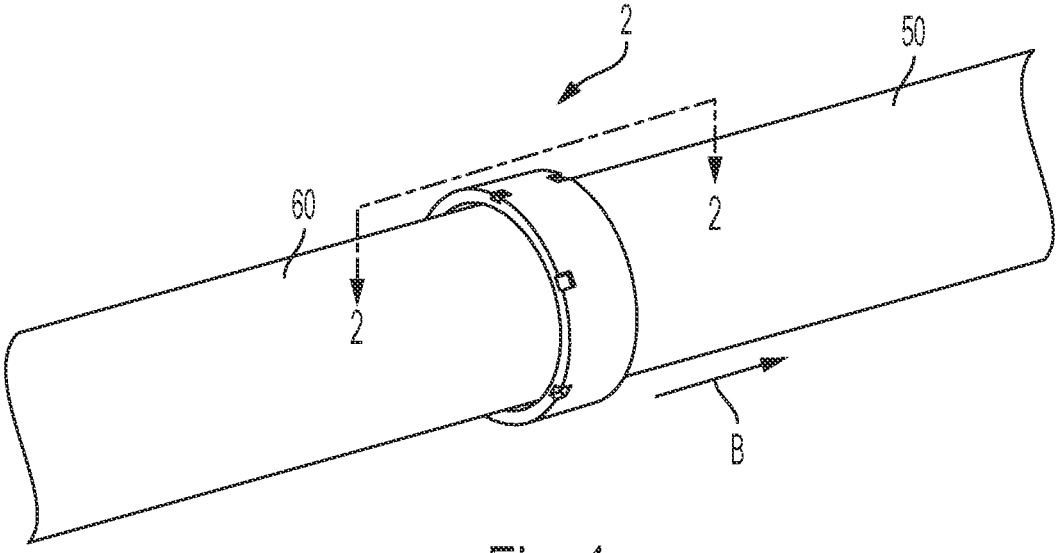
FIG. 1 is a perspective view of a pipe seal assembly coupling together two casing pipe sections according to a non-limiting embodiment.
Figure 2:
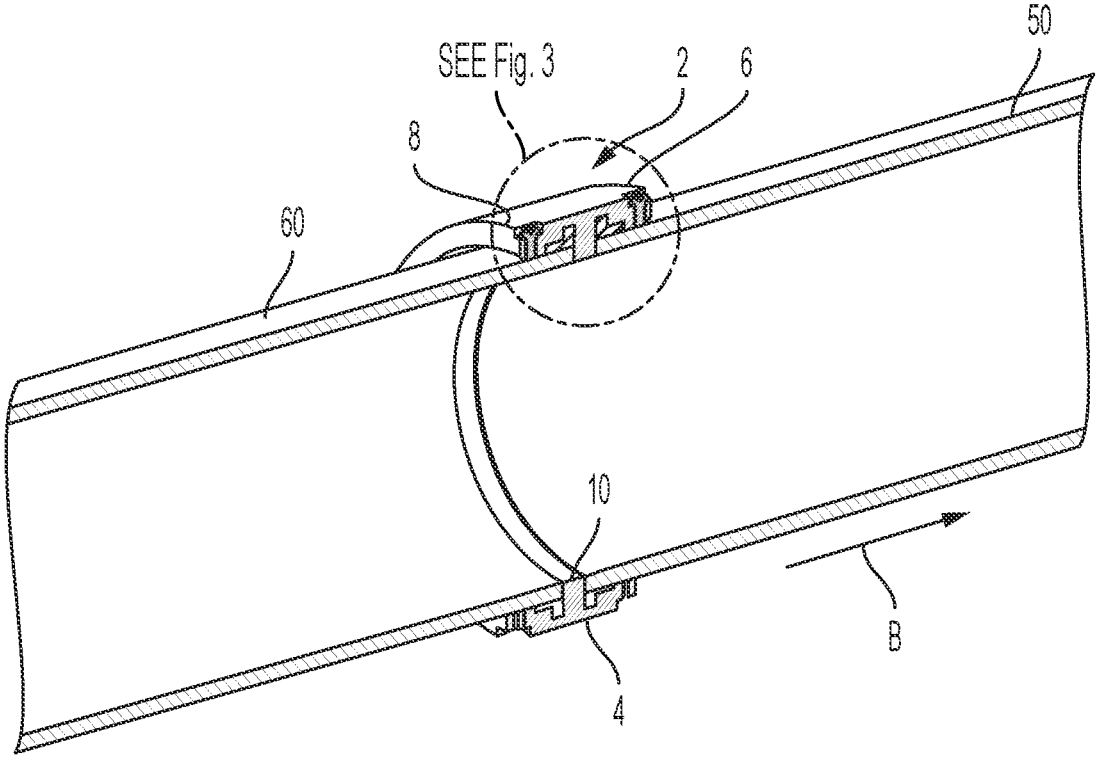
FIG. 2 is cross-sectional view taken along line 2-2 of FIG. 1.

The Pipe Seal Assembly:

FIGS. 1 and 2 illustrate a pipe seal assembly 2 connecting together a leading casing pipe section 50 and a trailing casing pipe section 60. The terms "leading" and "trailing" are used relative to a boring direction (arrow B) during bore hole formation. The pipe seal assembly 2 includes a main body in the form of a sleeve 4, which may have a cylindrical shape. The sleeve 4 has two receptacles 6, 8 that are joined together at an internal annular flange 10. The first receptacle 6 is for receiving an end of the leading casing pipe section 50. The second receptacle 8 for receiving an end of the trailing casing pipe section 60. The internal annular flange 10 projects in a radial inward direction from the sleeve 4, and serves as a stopper for axial inward displacement of the casing pipe sections 50, 60. The internal annular flange 10 is positioned between the confronting end faces of the casing pipe sections 50, 60, as shown in FIG. 2.

The entire sleeve 4 may be fabricated by casting steel, which would give the sleeve 4 (inclusive of the receptacles 6, 8 and the flange 10) a unitary, one-piece construction. But the invention is not limited in this regard as other materials and fabrication techniques may be suitably implemented.

Figure 3:
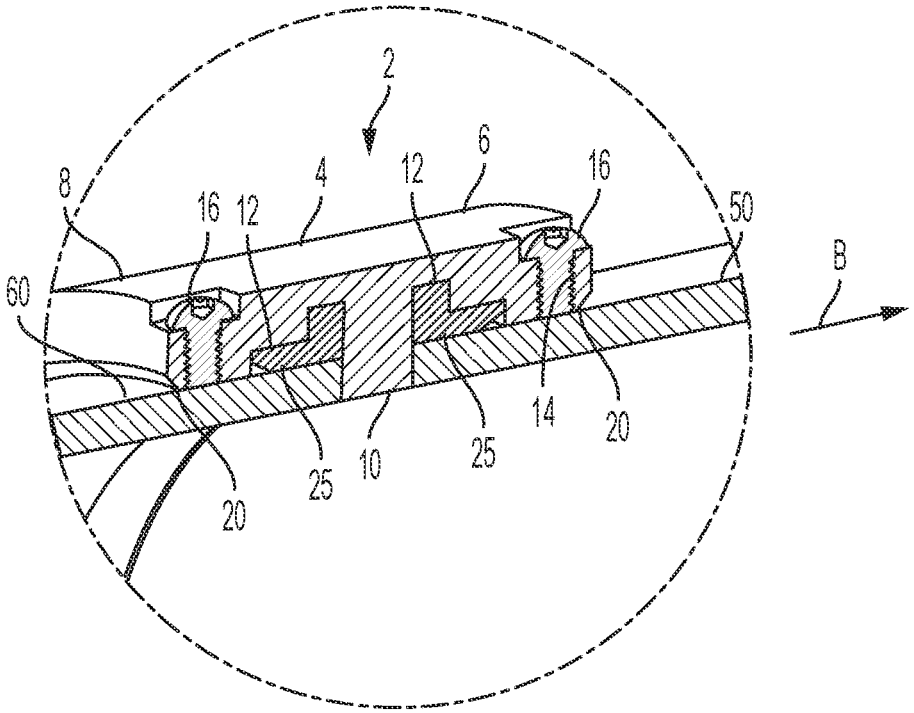
FIG. 3 is an enlarged partial view of FIG. 2.

Turning to FIG. 3, the receptacles 6, 8 may be symmetrical in construction. Each receptacle 6, 8 includes an internal cylindrical wall that extends in an axial direction away from the flange 10 and to a respective opening 20. The axial direction is parallel to the boring direction (arrow B). An internal annular groove 12 is formed in the internal cylindrical wall of each receptacle 6, 8. Each groove 12 may be partially defined by the flange 10. Each groove receives a respective sealing ring 25 that is fabricated from an elastic material, such as rubber for example. The sealing ring 25 may be shaped to bulge out of the groove 12 when no casing pipe section is inserted, but deformed so as to extend parallel to an outer cylindrical wall of an inserted casing pipe section, as shown in FIG. 3. It will be appreciated that grooves 12 and sealing rings 25 of various shapes and sizes may be suitably implemented. In the illustrated embodiment, each receptacle 6, 8 includes only one groove 12 and only one sealing ring 25, but the invention is not limited in this regard. Also, it will be readily apparent that the grooves 12 may be spaced apart from the internal annular flange 10.

A plurality of threaded holes 14 extend radially through each receptacle 6, 8 and open into the interior of the sleeve 4. The threaded holes 14 of each receptacle are spaced axially outward from the respective internal annular groove 12. The threaded holes 14 may be located circumferentially around each receptacle 6, 8. Each threaded hole 14 may receive a respective lock screw 16. The lock screw 16 may be tightened so that a distal end of the lock screw 16 advances in a radial inward direction and into the interior of the receptacle, and loosened to withdraw the lock screw 16 in a radial outward direction. The length of the lock screw 16 may be such that it does not project radially outward from the sleeve 4 when tightened, as shown in FIG. 3.

The Method of Installation:

FIGS. 4-7 illustrate an auger boring method to install a casing pipe from a drive pit 72 to a reception pit 74 and under a road 100 using a boring machine 70.

Figure 4:
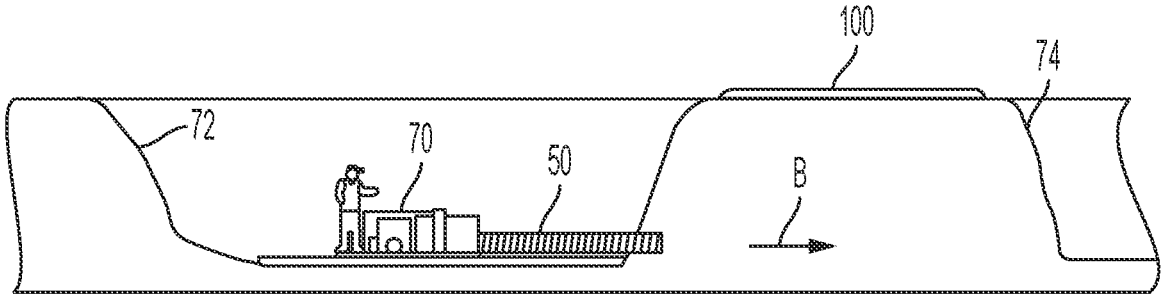
FIGS. 4-7 are schematic views of an auger boring method that involves installing the pipe seal assembly on a pair of casing pipe sections according to a non-limiting embodiment.

With reference to FIG. 4, the boring machine 70 is located in the drive pit 74 and operatively coupled to the leading casing pipe section 50 and the associated auger flight. The boring machine 70 rotates the auger flight as it pushes and advances a leading casing pipe section 50 in the boring direction (arrow B).

Figure 5:
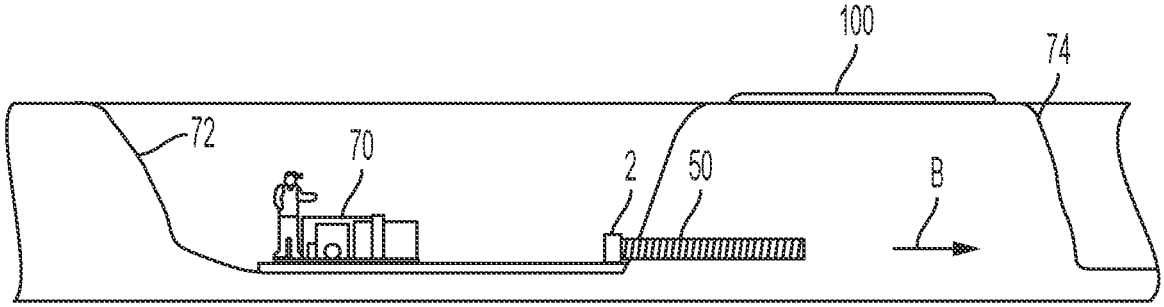

Once the leading casing pipe section 50 is pushed all the way in, the boring machine 70 is disconnected and moved toward the back of the drive pit 72, as shown in FIG. 5. The pipe seal assembly 2 is then mounted onto the leading casing pipe section 50. Here, the lock screws 16 are loosened to withdraw the lock screws 16 in a radial outward direction and out of the interior of the receptacles 6, 8. Next, the sleeve 4 is pushed onto the leading casing pipe section 50, such that the back end (the exposed end) of the leading casing pipe section 50 inserts into the opening 20 of the receptacle 6. The boring machine 70 may be used to push the pipe seal assembly 2 in the boring direction (arrow B) and onto the leading casing pipe section 50. It is not necessary at this time to achieve full insertion, i.e., the end face of the leading casing pipe section 50 may be spaced apart from the internal annular flange 10.

Figure 6:
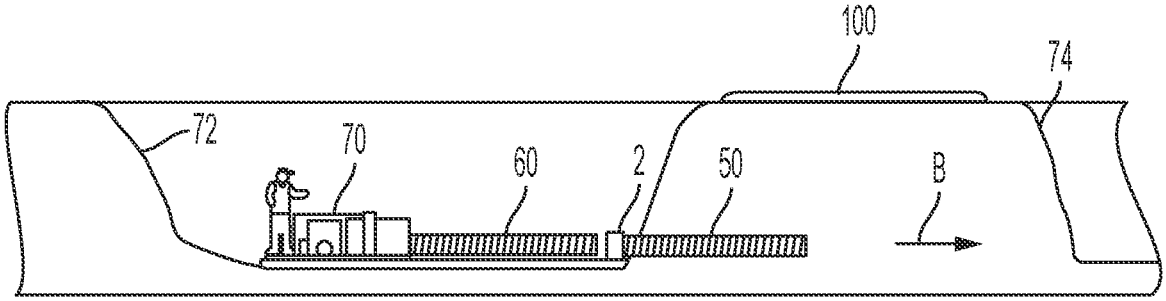

With reference to FIG. 6, the boring machine 70 is operatively coupled to the trailing casing pipe section 60 and the associated auger flight. As shown, the trailing casing pipe section 60 is spaced apart from the pipe seal assembly 2. The auger flights of the casing pipe sections 50, 60 may be coupled together according to conventional techniques.

Figure 7:
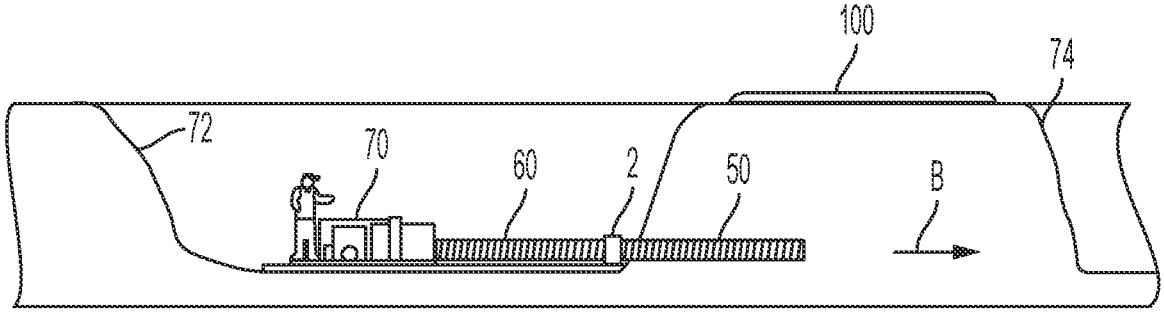

With reference to FIG. 7, the boring machine 70 pushes and advances the trailing casing pipe section 60 in the boring direction (arrow B), and without rotating the auger flights, until the front end of the trailing casing pipe section 60 inserts into the opening 20 of the receptacle 8. The advancement of the trailing casing pipe section 60 continues until the confronting end faces of the casing pipe sections 50, 60 abut against the internal annular flange 10, as shown in FIG. 3. The full insertion of the casing pipe sections 50, 60 into the receptacles 6, 8 can be confirmed by placing indicators (e.g., a groove or a painted line) on the external cylindrical wall of the casing pipe sections beforehand.

As the casing pipe sections 50, 60 insert into the receptacles 6, 8, the sealing rings 25 are compressed and deform into the grooves 12 to produce a good sealing affect.

To complete installation of the pipe seal assembly, the lock screws 16 are tightened so that their distal ends enter into the interiors of the receptacles and press against the casing pipe sections 50, 60. This will establish a firm interconnection between the pipe seal assembly 2 and the casing pipe sections 50, 60.

The boring machine 70 rotates the string of auger flights as it pushes and advances the trailing casing pipe section 60 (and thus the leading casing pipe section 50) in the boring direction (arrow B).

The process is repeated and additional casing pipe sections are sequentially added until the bore hole reaches the reception pit 74. The auger flights are then removed, leaving an installed casing pipe that extends from the drive pit 72 to the reception pit 74. The boring machine 70 may be used to pull the auger flights from the installed casing pipe and into the reception pit 72, where they can be disconnected one-by-one from the string and removed from the reception pit 72. One or more carrier pipes may then be inserted into the casing pipe.

It will be appreciated that the internal diameters of the receptacles 6, 8 may be slightly greater than the external diameters of the casing pipe sections 50, 60 to provide for a fit that allows for a press-on assembly as described above, yet resists excessive relative movements among the components. The press seal assembly 2 can be designed with receptacles that accommodate casing pipe sections having different diameters. Typically, casing pipe sections are available having standardized diameters.

Although the foregoing description is directed to the preferred embodiments of the present teachings, it is noted that other variations and modifications will be apparent to those skilled in the art, and which may be made without departing from the spirit or scope of the present teachings.

The foregoing detailed description of the various embodiments of the present teachings has been provided for the purposes of illustration and description. It is not intended to be exhaustive or to limit the present teachings to the precise embodiments disclosed. Many modifications and variations will be apparent to practitioners skilled in this art. The embodiments were chosen and described in order to explain the principles of the present teachings and their practical application, thereby enabling others skilled in the art to understand the present teachings for various embodiments and with various modifications as are suited to the particular use contemplated. It is intended that the scope of the present teachings be defined by the following claims and their equivalents.

What is claimed is:

1. An auger boring method comprising:

providing a pipe seal assembly that includes a sleeve with a leading receptacle and a trailing receptacle that are joined together at an internal annular flange;

pushing the pipe seal assembly in a boring direction onto a leading casing pipe section that accommodates a leading auger flight, such that an end of the leading casing pipe section inserts into the leading receptacle and confronts the internal annular flange; and pushing a trailing casing pipe section that accommodates a trailing auger flight in the boring direction, such that an end of the trailing casing pipe section inserts into the trailing receptacle and confronts the internal annular flange;

wherein the leading casing pipe section and the trailing casing pipe section abut against opposite sides of the internal annular flange;

providing a leading sealing ring in the leading receptacle;

compressing the leading sealing ring between the leading receptacle and the leading casing pipe section;

providing a trailing sealing ring in the trailing receptacle;

compressing the trailing sealing ring between the trailing receptacle and the trailing casing pipe section; and wherein the internal annular flange is interposed between and abuts against the leading sealing ring and the trailing sealing ring.

2. The method according to claim 1, further comprising:

tightening lock screws provided on each of the leading receptacle and the trailing receptacle to advance the lock screws in a radial inward direction, such that the lock screws press against the leading and the trailing casing pipe sections.

3. The method according to claim 1, wherein the leading casing pipe section and the trailing casing pipe section are not welded together.

4. The method according to claim 1, wherein the leading receptacle includes an internal annular groove that accommodates the leading sealing ring; and wherein the trailing receptacle includes an internal annular groove that accommodates the trailing sealing ring.

5. The method according to claim 1, wherein the pipe seal assembly is cast steel.

6. The method according to claim 1, wherein the leading casing pipe section is inserted into the leading receptacle before the trailing casing pipe section is inserted into the trailing receptacle.

7. The method according to claim 1, further comprising:

connecting the auger flight of the trailing casing pipe section to the auger flight of the leading casing pipe section.

8. The method according to claim 7, further comprising:

rotating the auger flights of the trailing and the leading casing pipe sections while pushing the trailing and the leading casing pipe sections in the boring direction.

9. The method according to claim 8, further comprising:

removing the auger flights from the trailing and the leading casing pipe sections.

10. An auger boring method comprising:

providing a pipe seal assembly that includes a sleeve with a leading receptacle and a trailing receptacle that are joined together at an internal annular flange;

pushing the pipe seal assembly in a boring direction onto a leading casing pipe section that accommodates a leading auger flight, such that an end of the leading casing pipe section inserts into the leading receptacle and confronts the internal annular flange;

pushing a trailing casing pipe section that accommodates a trailing auger flight in the boring direction, such that an end of the trailing casing pipe section inserts into the trailing receptacle and confronts the internal annular flange;

providing a leading sealing ring in the leading receptacle;

compressing the leading sealing ring between the leading receptacle and the leading casing pipe section;

providing a trailing sealing ring in the trailing receptacle; and compressing the trailing sealing ring between the trailing receptacle and the trailing casing pipe section;

wherein the leading receptacle includes an internal annular groove that accommodates the leading sealing ring;

wherein the trailing receptacle includes an internal annular groove that accommodates the trailing sealing ring; and wherein the internal annular flange at least partially defines the internal annular grooves of the leading and the trailing receptacles.

11. A pipe seal assembly for use in an auger boring method, the pipe seal assembly comprising:

a sleeve with a leading receptacle and a trailing receptacle that are joined together at an internal annular flange, each of the leading receptacle and the trailing receptacle including an internal annular groove, a sealing ring provided in the internal annular groove, a plurality of threaded holes that extend radially into an interior of the sleeve, and a lock screw provided in each of the threaded holes;

wherein the leading receptacle is configured to receive an end of a leading casing pipe section that accommodates a leading auger flight;

wherein the trailing receptacle is configured to receive an end of a trailing casing pipe section that accommodates a trailing auger flight; and wherein each of the leading receptacle and the trailing receptacle includes only one internal annular groove.

12. The pipe seal assembly according to claim 11, wherein the leading casing pipe section and the trailing casing pipe section abut against opposite sides of the internal annular flange.

13. The pipe seal assembly according to claim 11, wherein the sealing ring is fabricated from a rubber material.

* * * * *